US008648757B2

(12) United States Patent
Remski et al.

(10) Patent No.: US 8,648,757 B2
(45) Date of Patent: Feb. 11, 2014

(54) END-LOADED TOPOLOGY FOR D-PLANE POLARIZATION IMPROVEMENT

(75) Inventors: Richard T. Remski, Grand Prairie, TX (US); Kevin W. Ommodt, Allen, TX (US); James M. Irion, II, Allen, TX (US)

(73) Assignee: Raytheon Company, Waltham, MA (US)

( * ) Notice: Subject to any disclaimer, the term of this patent is extended or adjusted under 35 U.S.C. 154(b) by 504 days.

(21) Appl. No.: 12/771,933

(22) Filed: Apr. 30, 2010

(65) Prior Publication Data

US 2011/0267248 A1 Nov. 3, 2011

(51) Int. Cl.
*H01Q 13/10* (2006.01)
*H01Q 21/00* (2006.01)

(52) U.S. Cl.
USPC ..... 343/767; 343/770

(58) Field of Classification Search
USPC ..... 343/767, 770, 771
See application file for complete search history.

(56) References Cited

U.S. PATENT DOCUMENTS

| | | | | |
|---|---|---|---|---|
| 5,220,330 | A * | 6/1993 | Salvail et al. | 342/62 |
| 5,311,199 | A * | 5/1994 | Fraschilla et al. | 343/767 |
| 5,845,391 | A * | 12/1998 | Bellus et al. | 29/600 |
| 6,850,203 | B1 | 2/2005 | Schuneman et al. | |
| 6,867,742 | B1 | 3/2005 | Irion, II et al. | |
| 6,963,312 | B2 | 11/2005 | Schuneman et al. | |
| 7,271,775 | B1 * | 9/2007 | Rossman et al. | 343/728 |

* cited by examiner

*Primary Examiner* — Michael C Wimer
(74) *Attorney, Agent, or Firm* — Christie, Parker & Hale, LLP

(57) ABSTRACT

The embodiments described herein are directed to providing a notched antenna element for improving polarization control without sacrificing gain, bandwidth, scan volume, recurring cost, or manufacturability. The notched antenna element includes a base portion comprising a plurality of contiguous first cross-sectional notched antenna elements, each of the plurality of first cross-sectional notched antenna elements configured in an end-loaded structure for increasing polarization stability; and an upper portion coupled to the base portion, the upper portion comprising a plurality of contiguous second cross-sectional notch antenna elements.

12 Claims, 9 Drawing Sheets

(Pyramidal design)

(End-loaded design)

END-LOADED TOPOLOGY FOR D-PLANE POLARIZATION IMPROVEMENT

CROSS-REFERENCE TO RELATED APPLICATION(S)

This application is an improvement upon and incorporates by reference in its entirety, as if set forth in full, U.S. Pat. No. 6,850,203, filed on Dec. 14, 2001.

BACKGROUND

1. Field

Embodiments described herein relate in general to tapered slot antennas and, more particularly, to a method and apparatus for improved D-Plane polarization in such antennas.

2. Description of Related Art

During recent decades, antenna technology has experienced an increase in the use of antennas that utilize an array of antenna elements, one example of which is a phased array antenna. Phased array antennas have many applications in commercial and defense markets, such as communications and radar systems. In many of these applications, broadband performance is desirable. Some of these antennas are designed so that they can be switched between two or more discrete frequency bands. Thus, at any given time, the antenna operates in only one of these multiple bands. However, in order to achieve true broadband operation, an antenna needs to be capable of satisfactory operation in a single wide frequency band, without the need to switch between two or more discrete frequency bands. One type of antenna element that has been found to work well in an array antenna is often referred to as a tapered slot antenna element.

Phased Arrays have several primary performance characteristics including bandwidth, scan range, and polarization. Bandwidth is the frequency range over which an antenna provides a good enough match and gain for useful operation. Wider bandwidths generally require some form of balun structure for current balancing at the base, as well as some form of impedance matching structure to permit good energy transfer to and from the feed circuit over the band of operation.

Scan range (or field of view), refers to the range of angles, beginning at boresight or normal to the array plane, over which phasing of the relative element excitations can steer or scan the array beam. Scanning for a linear element polarization is often referred to as being in the electric field plane (E-plane), magnetic field plane (H-plane), or diagonal plane between the electric and magnetic field orientations (D-plane). Maximum scan range is primarily set by the antenna element or "cell" spacing relative to the wavelength at the high end of the band.

Polarization refers to the orientation or alignment of the electric field radiated by the array. An ideal array of elements has a fixed E-field alignment for all, elements, over both the frequency bandwidth and the scan range. This polarization may be linear (a fixed orientation), circular (a specific superposition of polarizations), or many states in between. A dual-polarized array has essentially two co-located antenna elements at each point of the array which can function independently.

Usually the maximum allowable cell spacing is determined by the desired scan angle coverage at the maximum frequency of operation. Once cell size is specified, matching to a desired minimum frequency is achieved by increasing the element length to allow for an impedance taper. However, element length causes vertical currents which influence polarization, regardless of the element type. E-plane and H-plane scans are usually not affected. But in the D-plane scan, the polarization of a tapered notch element does not remain linearly oriented to the notch gap, and is with the change in polarization increasing as scan angle increases. This effect is magnified as the element length increases, or as the separation between the minimum and maximum frequency of operation is increased.

Existing designs and design techniques have not been able to provide a tapered slot antenna element which compensates for D-plane polarization instability without sacrificing gain, bandwidth, scan volume, or manufacturability of the array.

SUMMARY

Aspects according to embodiments described herein provide increases in D-plane polarization control without a significant degradation in gain, bandwidth, scan volume, or manufacturability.

According to an embodiment described herein, an antenna apparatus includes a notched antenna element extending generally in a longitudinal direction and including: a base portion including a plurality of contiguous first lateral cross-sectional shapes, each of the plurality of first lateral cross-sectional shapes being end-loaded for increasing polarization stability; and an upper portion coupled to the base portion, the upper portion comprising a plurality of contiguous second lateral cross-sectional shapes.

The antenna may further comprise a balun portion coupled to the base portion and an end-piece portion coupled to the upper portion.

The plurality of contiguous first lateral cross-sectional shapes may generally decrease in width from a first shape of the plurality of contiguous first lateral cross-sectional shapes to the last shape of the plurality of contiguous first lateral cross-sectional shapes. Additionally, the plurality of contiguous second lateral cross-sectional shapes may generally decrease in width from a first shape of the plurality of contiguous second lateral cross-sectional shapes to the last shape of the plurality of contiguous second lateral cross-sectional shapes.

In each of the plurality of first lateral cross-sectional shapes, the end-loaded structure may comprise four symmetric fins extending outward from a center line to an outer perimeter, the width of each of the fins at the outer perimeter may be greater than the width of the corresponding fin at the center line.

In each of the plurality of first lateral cross-sectional shapes, the end-loaded structure may comprise four symmetric fins extending outward from a center line to an outer perimeter, and wherein the width of each of the fins at the outer perimeter is substantially greater than the width of the corresponding fin at the center line.

At least one of the plurality of contiguous second lateral cross-sectional shapes is end-loaded.

Each of the base portion and the upper portion may be injected molded.

The antenna apparatus may be a dual-polarized, broadband, exponentially tapered, phased antenna array.

According to another embodiment described herein, a method of controlling antenna polarization in a notched antenna array comprises: shaping a plurality of first lateral cross-sectional, shapes in an end-loaded structure; coupling the plurality of first lateral cross-sectional shapes together to form a base portion of an antenna of the notched antenna array; shaping a plurality of second lateral cross-sectional shapes; coupling the plurality of second lateral cross-sectional shapes together to form an upper portion in each of the antennas of the notched antenna array; and coupling the base portion to the upper portion.

Each of the plurality of first lateral cross-sectional shapes may comprise four symmetric fins extending outward from a center line to an outer perimeter, wherein the width of each of the fins at the outer perimeter may be wider than the width of the corresponding fin at the center line.

Shaping the plurality of the second lateral cross-sectional shapes may comprise shaping at least one of the plurality of second lateral cross-sectional shapes in a cross-sectional end-loaded structure.

Shaping of the plurality of first lateral cross-sectional shapes may comprise injection molding the base portion.

Shaping of the plurality of second lateral cross-sectional shapes may comprise injection molding the upper portion.

These and other features, aspects, and embodiments are described below in the section entitled "Detailed Description."

BRIEF DESCRIPTION OF THE DRAWINGS

Features, aspects, and embodiments are described in conjunction with the attached drawings, in which.

DETAILED DESCRIPTION

Figure 1:
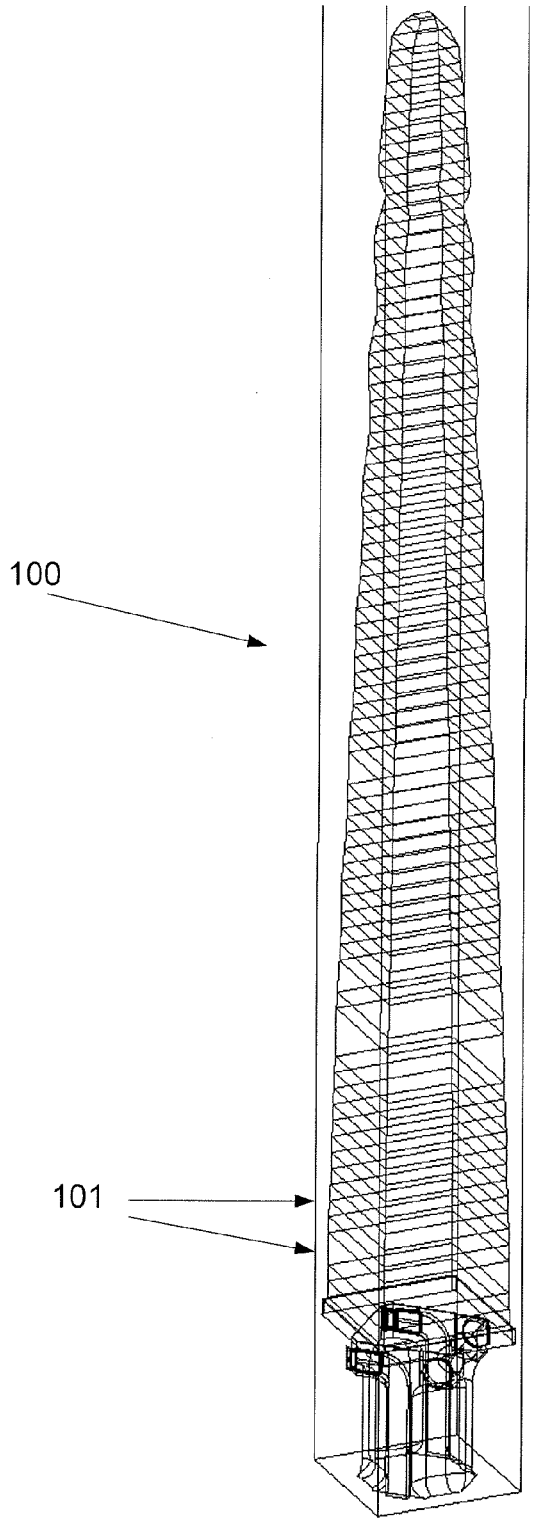
Fig. 1 (Prior Art)
FIG. 1 is a perspective view of a tapered notch antenna element according to the prior art.

Exemplary embodiments will now be described more fully with reference to the accompanying drawings. Like reference numerals in the drawings denote like elements.

Dual-polarization array systems are often required for certain applications because two orthogonal polarization states can be combined to synthesize any desired polarization, including circular or elliptical polarization definitions, for either reception or transmission. In ideal practice the definition of the two polarization states remains fixed over all scan and frequency states of the array operation. In actual practice however, extending either bandwidth or scan angle coverage of the array results in variations in the polarization state of each of the dual element types in the array. This behavior is seen most frequently in the higher portion of a given functional frequency range, and at higher scan angles from the normal in the D-plane. As long at the two polarizations remain orthogonal to one another this effect may not be critical, however each time the elements alter polarization, in either scan- or frequency-space, the potential for decreased orthogonality (missed signals) increases at distinct intervals within that space, e.g., the crossing points may not remain orthogonal.

Polarization control in dual-polarized arrays is primarily achieved by defining the ideal polarization alignment of the antenna elements at boresight by virtue of basic geometry (e.g. a notch aperture oriented in the "X" vs. the "Y" plane). Current practice does not generally attempt to 'control' this polarization by design with increasing bandwidth or with increasing scan angle requirements. In tapered notch antennas specifically, the innate polarization behavior of the element in the D-plane is considered to be its natural behavior.

One method of increasing polarization stability over scan includes using some form of a dielectric connection between elements. However, this method creates manufacturing difficulties, and may result in decreases in bandwidth, efficiency, and gain of the antenna array. Additionally, because of the presence of dielectric decreases the effective wavelength within the antenna element, the allowed unit cell spacing of the array shrinks, which can result in front-end electronic packaging issues.

D-plane polarization variation occurs even in single-polarization tapered notch arrays, but this effect is sometimes masked by the implementation of tapered notch elements on circuit boards, as the dielectric of the board helps concentrate fields in such as way as to reduce the polarization rotation despite the element length. Therefore the behavior is suppressed into extreme limits of high frequency (within the band) and high D-plane scan angles. However, in many application a board-based array is not an acceptable solution due to a combination of etch and board trimming tolerances, as well as coefficient of thermal expansion (CTE) concerns.

A dual-polarized, circuit-board based tapered notch array results in an "egg crate" design of interlocking boards. Extending the same board-based manufacturing tolerance issues in two planes increases the complication to large-scale producibility and part interference results in tolerances becoming additive along an array. Additionally, interfacing the array with the electronics behind it becomes impractical or very difficult due to the requirement to solder on two different board planes.

Similarly, dielectric loading between non-circuit-board based metal elements can assist the polarization effects by focusing fields into the dielectric, but only if the dielectric fills the gaps completely. Thus, the same tolerance and interference effects apply: manufacturing tolerance must be very strict as undersized parts create gaps which negate the performance improvement, and oversized parts risk interference cause the same additive effect. In order to increase manufacturability, isolated radiator spikes were developed, but this solution suffers from a loss of polarization control due to removal of the dielectric. Therefore, the prior art demonstrates a direct tradeoff between improved producibility and decreased polarization stability.

FIG. 1 is a perspective view of a tapered notch antenna element according to the prior art. Instead of tapering like a spike, a tapered slot antenna, such as in FIG. 1 has a shape which is optimized as a function of factors. Each slot edge follows a predetermined curve other than a first order exponential curve, as is described in U.S. Pat. No. 6,850,203, the entirety of which has been incorporated herein by reference.

According to FIG. 1, an antenna apparatus 100, includes a plurality of contiguous cross-sectional slots 101 that vary in width, generally decreasing from the base to the top of the antenna apparatus 100.

Figure 2:
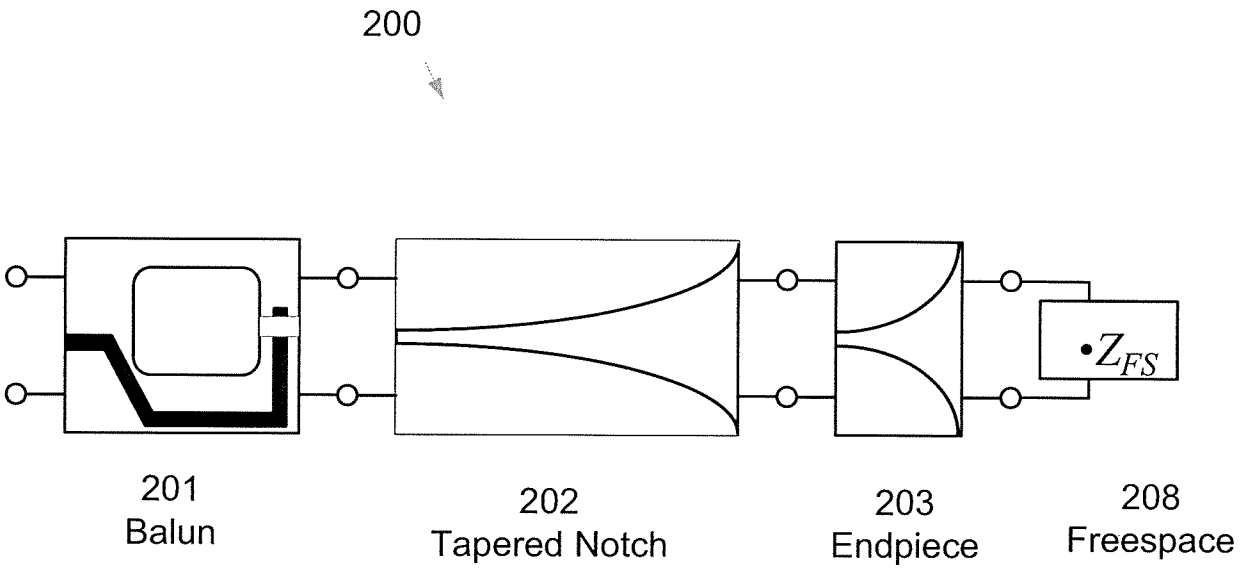
Fig. 2 (Prior Art)
FIG. 2 is a block diagram illustrating an antenna element according to the prior art.

FIG. 2 is a block diagram illustrating an antenna element according to the prior art.

According to FIG. 2, the three blocks 201-203 respectively represent three functional sections of the antenna element 200, namely a balun 201, a tapered notch 202, and an end-piece 203. Collectively, blocks 201-203 represent the antenna apparatus 200, and can be used to abstractly represent, e.g., the antenna apparatus 100.

For example, the cross-sectional slots 101, taken as a whole, can be represented by the tapered notch 202. The end-piece 203 has a port on the right side coupled to a further block 208, which diagrammatically represents the impedance of the free space disposed beyond the end of e.g., the apparatus 100 in FIG. 1.

Figure 3:
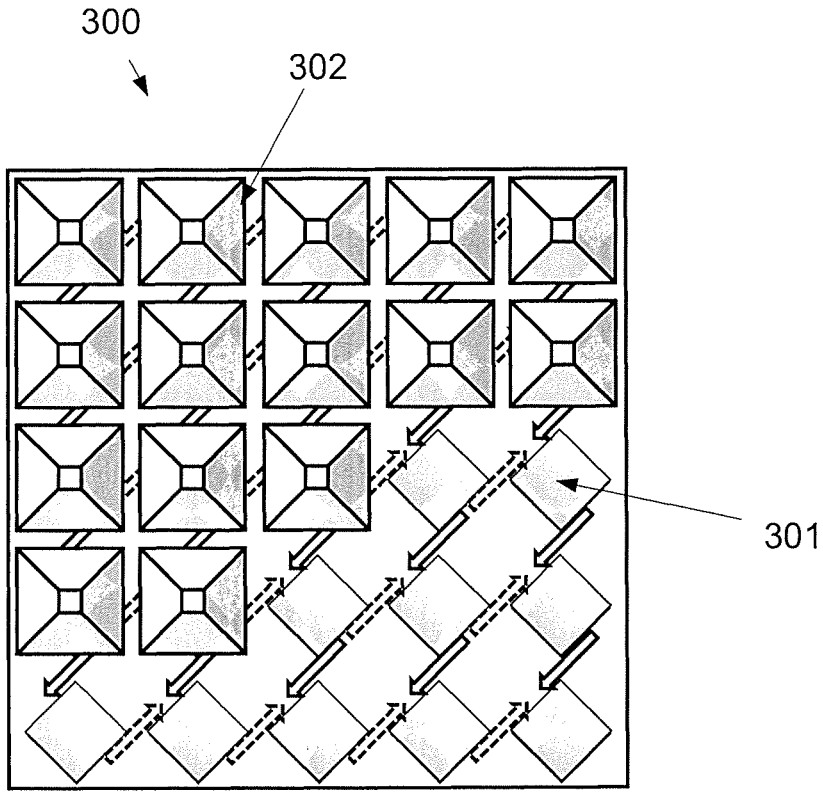
Fig. 3 (Prior Art)
FIG. 3 is an illustration of a phased antenna array according to the prior art.

FIG. 3 is an illustration of a phased antenna array according to the prior art. According to FIG. 3, the illustration represents a top-down view of a portion of an antenna array according to the prior art. The antenna array 300 comprises multiple balun posts 301, which support angled feed sources. A top balun posts 301 a metal shape comprising one half of a tapered slot for each of two polarizations is placed. According to FIG. 3, the antenna apparatus cross-sections have a square shape that tapers upward. This arrangement of the antenna apparatus can be referred to as pyramidal or a pyramid shape.

Figure 4A:
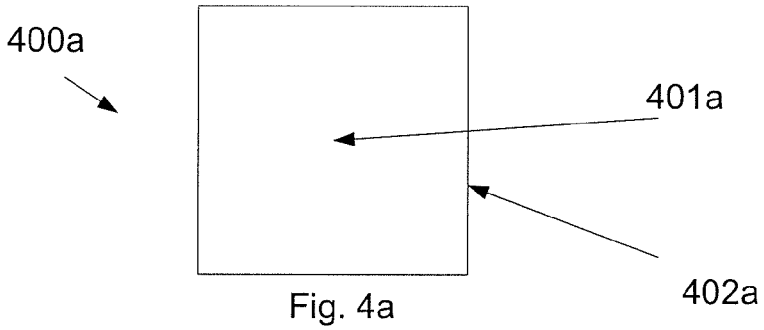
Fig. 4a (Prior Art)
FIGS. 4*a*-4*c* are outlines of the antennae cross-sections, that can be included in a phased antenna array as illustrated in FIGS. 2 and 3, according to the prior art.
Figure 4B:
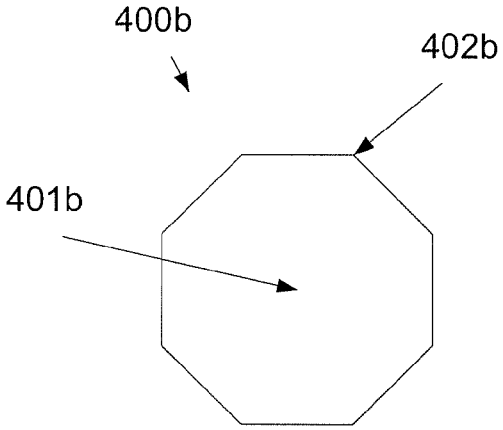
Fig. 4b (Prior Art)
Figure 4C:
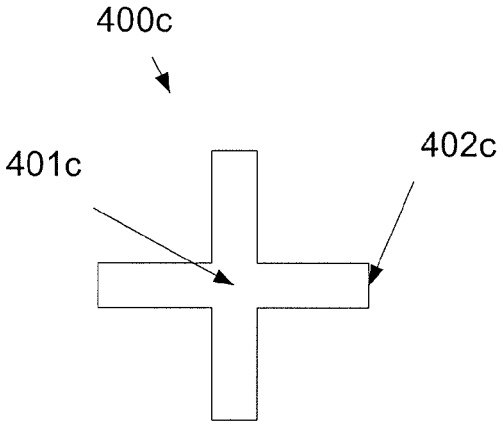
Fig. 4c (Prior Art)

FIGS. 4*a*-4*c* are outlines of the antennae cross-sections, that can be included in a phased antenna array as illustrated in FIG. 3, according to the prior art. For instance FIG. 4*a* is a square cross-sectional shape 400*a*, as in FIG. 3. FIG. 4*b* is an octagonal cross-sectional shape 400*b*, and FIG. 4*c* is a cross or "quad-fin" cross-sectional shape 400*c*.

In an antenna apparatus 100, the width of a cross-sectional shape 400*a*-400*c* tapers as it extends from the balun 201. The center lines 401a-401c of the cross-sectional shapes 400*a*-400*c* is the center point of the corresponding shapes and extends to each contiguous cross-section shape 400*a*-400*c* in a tapered notch 202 (as seen in the antenna apparatus 100).

The segments of FIGS. 4*b* and 4*c*, reduce the metal in the diagonal region (e.g., the amount of metal between diagonally adjacent antennae), but eliminate too much width at the perimeter for coupling to the horizontally or vertically adjacent antennae. To compensate, the gap between adjacent elements must become narrower for impedance matching, thus introducing bandwidth or assembly tolerance issues. This is particularly true with the "cross" shape 400*c* which has the narrow fins at the perimeter 402*c*.

Therefore, quad-fin and octagonal cross-sections are unsuccessful in compensating for D-Plane polarization without sacrificing producibility, bandwidth, or scan volume.

Figure 5:
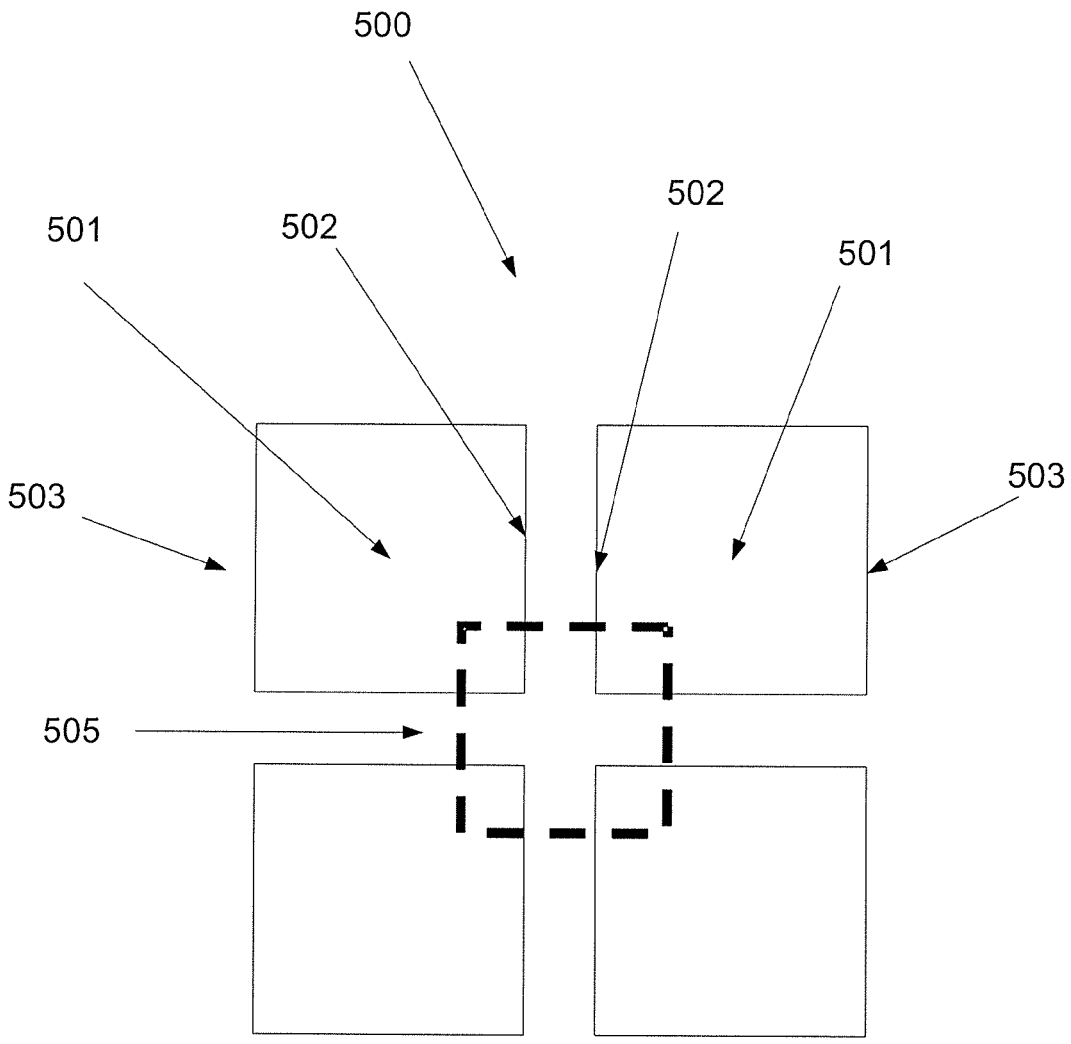
Fig. 5 (Prior Art)
FIG. 5 is an illustration of adjacent antennas in an antenna array according to a shape as illustrated in FIG. 4*a*, according to the prior art.

FIG. 5 is an illustration of adjacent antennas in an antenna array according to a shape as illustrated in FIG. 4*a*, according to the prior art. The antenna array 500, includes a plurality of antenna elements 503. Each element has a corresponding center line 501, and a perimeter 502. The dotted square 505 shows an area between the elements 503 that contains metal (e.g., the corner of the elements 503).

Figure 6A:
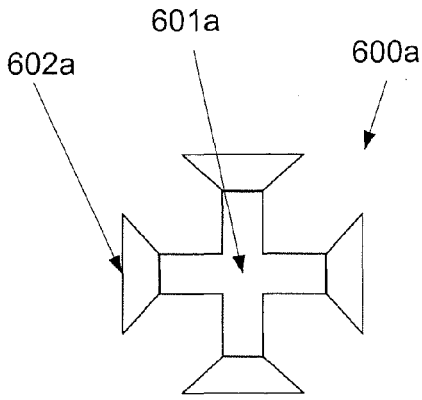
FIGS. 6*a* and 6*b* illustrate two exemplary cross-sections of an antenna according to embodiments of the present invention.
Figure 6B:
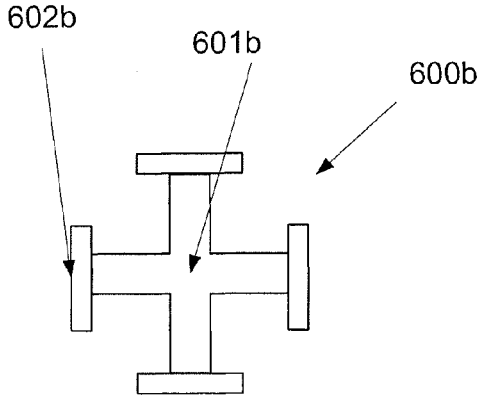

FIGS. 6*a* and 6*b* illustrate two exemplary cross-sections of an antenna according to embodiments of the present invention. The antenna apparatus according to shapes 600*a* and 600*b* include a center-line 601*a* and 601*b* and end-loaded portions 602*a* and 602*b* at the perimeter of the cross-section. These designs are referred to as end-loaded designs (FIGS. 6*a* and 6*b*) or a Jerusalem cross design (i.e., FIG. 6*b*).

According to FIGS. 6*a* and 6*b*, the end-load portions 602*a* and 602*b* may be coupled to the center line 601*a* and 601*b* through the "quad-fins". More specifically, according to embodiments illustrated in FIGS. 6*a* and 6*b*, the end-loaded structure comprises four symmetric fins extending outward from a center line 601*a* to an outer perimeter 602*a* and 602*b*. The width of each of the fins at the outer perimeter 602*a* and 602*b* is greater (e.g., substantially greater) than the width of the corresponding fin at the center line.

Other end-loaded arrangements may also be used, and the invention is not limited thereto, see e.g., FIGS. 6*a*, 6*b*, 8*a*, 8*b*, and 9*b*. The end-loaded portions 602*a*, 602*b*, 802*a*, 802*b*, and 902, are wider than the portions extending from the center-line 601*a*, 601*b*, 801*a*, 801*b*, and 803.

According to aspects of the current invention, polarization control is increased by reducing unwanted coupling to the next diagonal element, while preserving a desired gap to the next horizontal or vertical element in the array.

Figure 7:
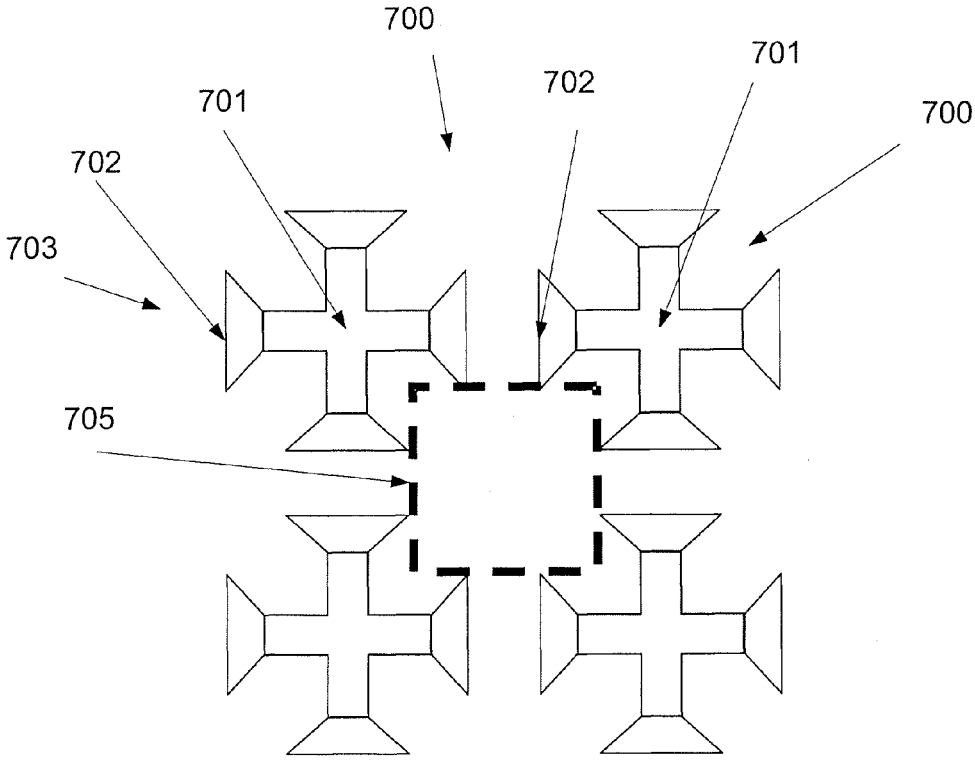
FIG. 7 is an illustration of adjacent antenna cross-sections in antenna array, where each cross-section has a shape of the type illustrated in FIG. 6*a*.

FIG. 7 is an illustration of adjacent anterma cross-sections in an anterma array, where each cross-section has a shape of the type illustrated in FIG. 6*a*. The element shape has less metal in the diagonal region 705 (dashed box) and increases the perimeter outline of the element. While not bound by any theory, this is believed to assist in polarization control by reducing unwanted coupling to the next diagonal element, while the end-loaded portion 702 preserves a desired gap to the next horizontal or vertical element in the array.

The end-loaded design permits preservation of match and element spacing by maintaining a large surface metal to metal proximity (similar to the square design) at the perimeters 602*a*, 602*b*, and 702. Additionally, in practice, the corner notches offer greater polarization stability than even the cross 400*c* configuration.

Furthermore, very thin end-loads, e.g. 602*b* rather than 602*a*, have, in practice, provided better stability. However, the ends must be sufficiently thick to retain the ability to injection-mold the part. Thus, ideal dimensions are limited in part by manufacturing considerations.

Thus, a cross-sectional topological shape as in 602*a* and 602*b*, can be utilized as a means of polarization control in the diagonal scan plane of an array of said apertures. According to one embodiment herein, end-loaded shaping can be utilized along a continuously changing (exponential) tapered gap or notch, forming an antenna aperture to control polarization stability.

Local alteration of the cross-sectional shape or end bar width can be performed for impedance matching control over a broad band for an array element. Alteration of the cross-sectional shape or the end bar width vs. antenna length can be adjusted to create an effective proximal metal surface area and therefore bandwidth is not adversely impacted. Use of an end-loaded cross-section preserves a desired target impedance at the antenna base with a larger spacing to the adjacent cross-section, thereby maintaining the producibility aspects of the original design.

Accordingly, aspects of embodiments of the current invention allow the array element to fit within the same cell size as the one being replaced (e.g., quad fin, square, or octagonal element). Along with the same cell size, antenna gain and efficiency are also preserved.

Although end-loaded shapes are more complex than (e.g., a square) and require, e.g. a higher mold complexity, and increased non recurring expense (NRE), the element shape can still be injection molded. Therefore, end-loaded antenna elements do not greatly increase (or do not increase at all) the per-unit manufacture cost. Furthermore, there is no increase in assembly costs due to, e.g., tighter spacing between elements. Additionally, no dielectrics are required, which would require smaller cell spacing for the same scan angle performance. There is also no additive tolerance error walk due to a connected dielectric board configuration.

Figure 10A:
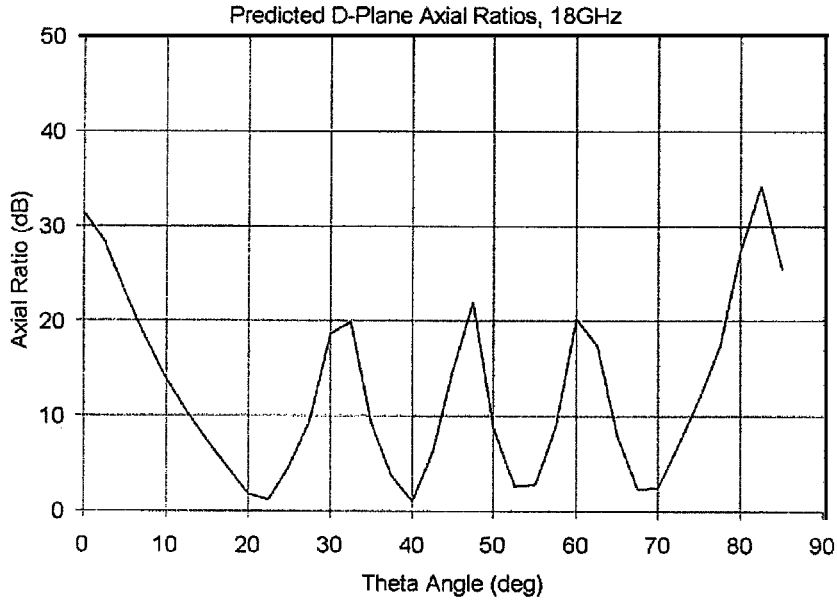
FIGS. 10*a* and 10*b* are graphs showing polarization performance.
Figure 10B:
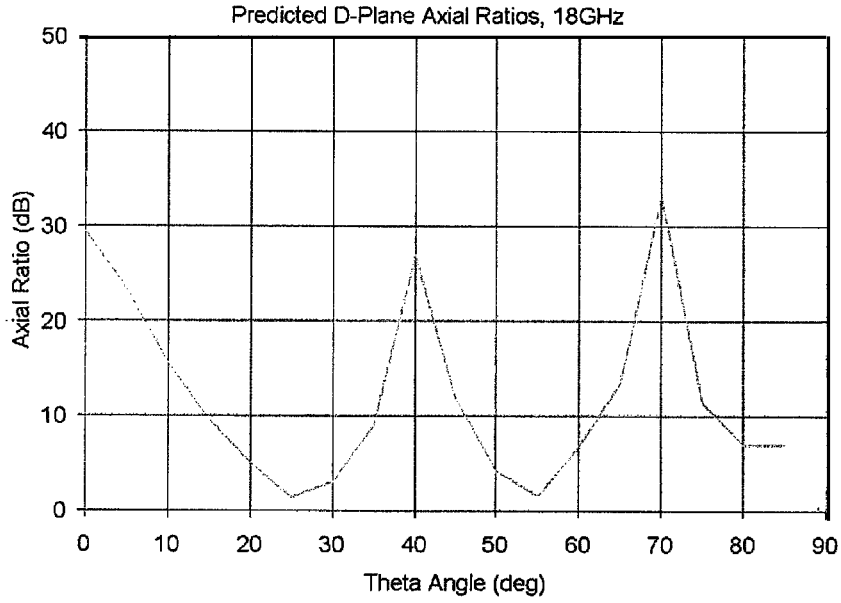

FIGS. 10*a* and 10*b* are graphs showing polarization performance versus scan angle at the maximum frequency of operation. FIG. 10*a* shows a relatively poor polarization performance according to a conventional pyramidal antenna design. In contrast FIG. 10B shows a significantly better D-plane polarization performance as achieved by an end-loaded design of the type described herein. For instance, the end-loaded design of FIG. 10*b* shows only two cycles vs. four cycles of the conventional pyramidal design shown in FIG. 10*a*.

The usable scan angle and bandwidth is similar to that of an equivalently-optimized pyramidal tapered notch element using the same array element spacing. Additionally, optimization matching techniques map directly from old elements (single variable vs. length) to new elements (two variables vs. length) and transitions between topologies can be managed to minimize in-band ripple consequences to return loss.

Testing shows that an end-loaded design offers approximately twice the D-plane polarization control of similar tapered notch elements, without sacrificing gain, bandwidth, scan volume, recurring cost, or manufacturability. In testing, the polarization stability of the end-loaded design equals that of a simple quad-fin at about 60% of the original length, in terms of the minimum frequency and scan angle in the diagonal (D) plane over which polarization rotation occurs. Furthermore, the cycle count may be reduced to 50% over an equivalent prior art design. For comparison, a 60% element length would sacrifice nearly half the bandwidth (from ~12:1 down to ~7.7:1) by raising the lowest frequency to which the shorter taper could match, assuming identical assembly gap constraints.

Figure 8A:
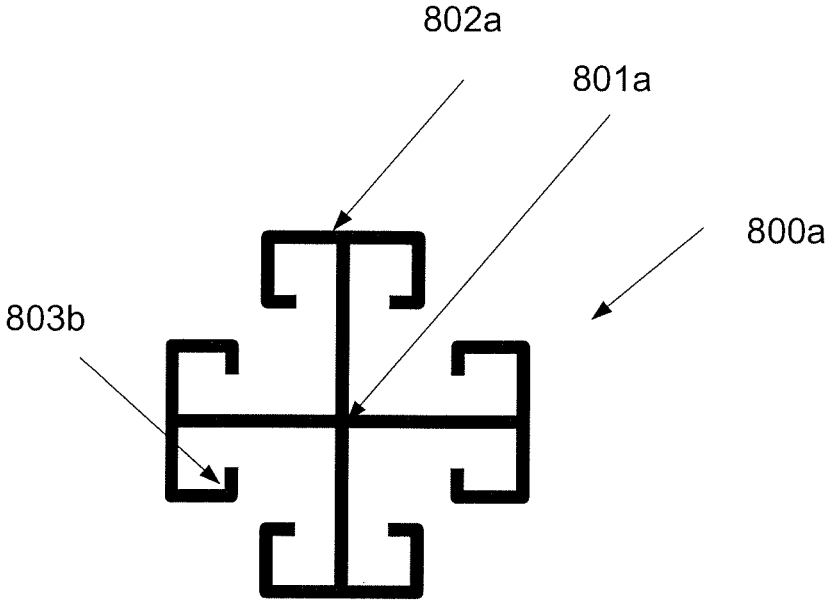
FIGS. 8*a* and 8*b* illustrate alternative shapes of exemplary antennae cross-sections according to embodiments disclosed herein.
Figure 8B:
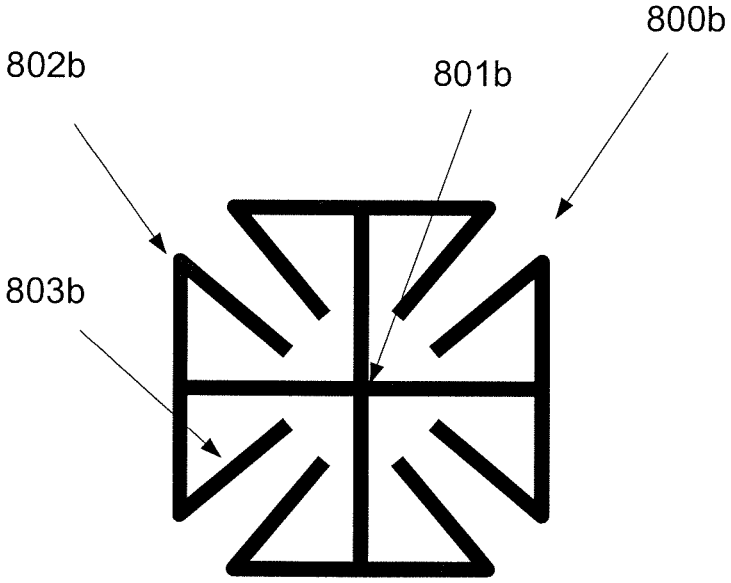

FIGS. 8*a* and 8*b* illustrate alternative shapes of exemplary antennae cross-sections according to embodiments disclosed herein.

Accordingly, exemplary embodiments described herein vary the cross-section shape by modifying the "end-bars" to further increase the return-current path around the perimeter of the cross-section, which may theoretically enhance the polarization benefits. The increased end-bar length is folded in such a way as to stay within the element unit cell spacing and maintain the same proximal length to the adjacent element end-bar for impedance matching preservation. Thus, according to FIGS. 8*a* and 8*b*, embodiments include a center line 801*a* and 801*b*, an end-loaded perimeter 802*a* and 802*b*, and a folded addition to the end-loaded portion 803*a* and 803*b*.

The folded path portion 803*a* and 803*b* adds an additional dimensional behavior for consideration by the designer, by using topology to intentionally increase the current return-path length (the perimeter of one quadrant of the element) in the cross-sectional direction between diagonally adjacent elements, for polarization shaping purposes.

However, while the cross-section shapes 800*a* and 800*b* including folded end-bar additions 803*a* and 803*b*, may provide a theoretical performance increase over designs without a the additional length, because of the complexity of the shape (e.g., the perimeter bending back inward), these designs are more difficult to manufacture with current injection molding methods.

Figures 9A, 9B:
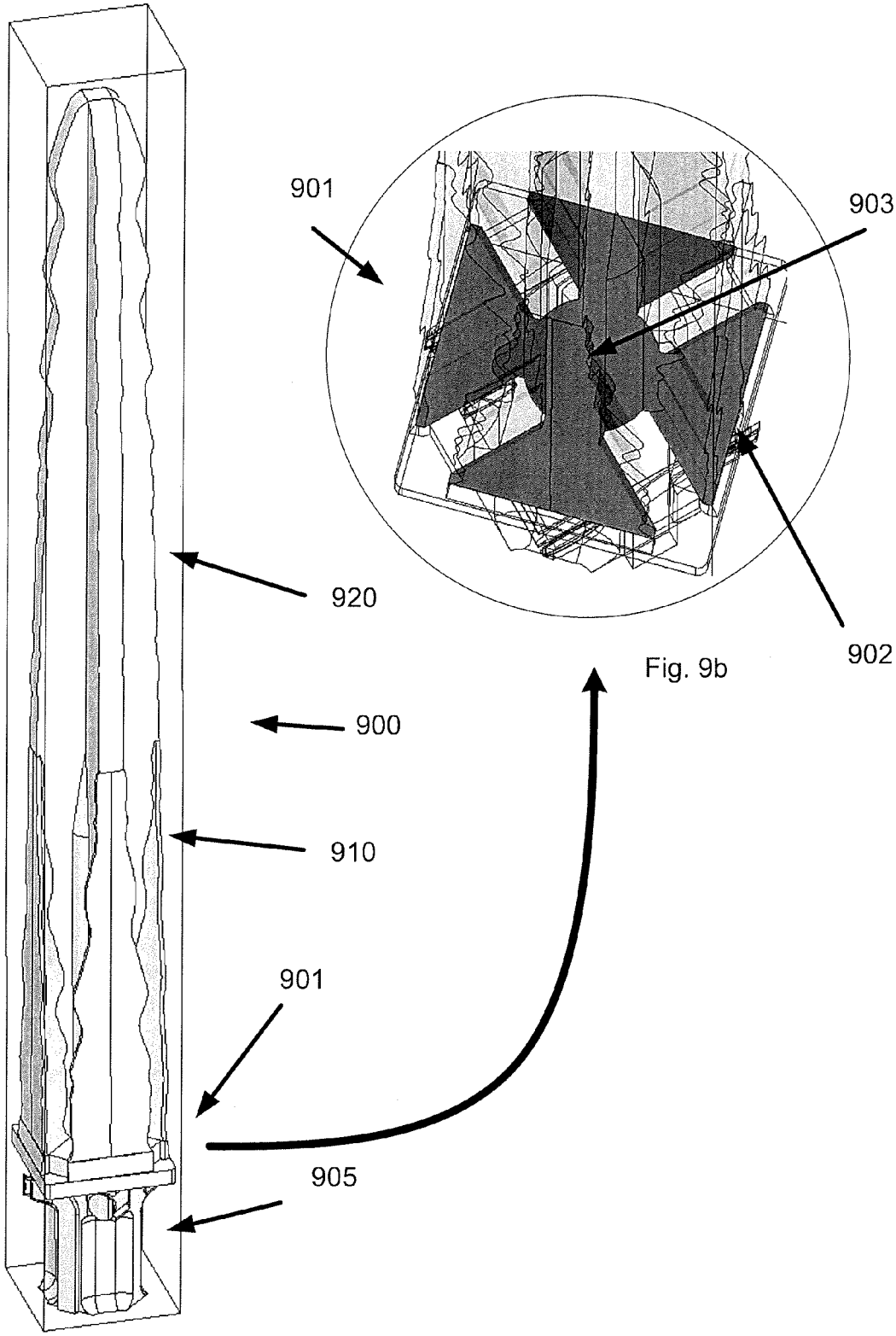
FIG. 9*a* is an illustration of a tapered notch antenna element according to an embodiment disclosed herein.
FIG. 9*b* is an exploded illustration of the tapered notch antenna as illustrated in FIG. 9*a*.

FIG. 9*a* is an illustration of a tapered notch antenna element according to an embodiment disclosed herein. FIG. 9*b* is an exploded illustration of the tapered notch antenna as illustrated in FIG. 9*a*.

FIG. 9*a* shows one of a pair of tapered notch antenna apparatuses or "spiked" antenna elements 900 extending generally in a longitudinal direction from a bottom to a top, each spiked antenna element, including an upper portion 920 coupled to base portion 910, coupled to a balun portion 905. The base portion includes a first lateral cross-sectional shape 901, which is shown in more detail in the exploded view of FIG. 9*b*. The cross-sectional shape includes a center line 903 and an end-loaded portion. The exact shape and size of the cross-section may vary based on design needs. FIG. 9*b* illustrates a base portion 910 comprising end-loaded lateral cross-sectional shapes 902. In FIG. 9*b*, the portion immediately surrounding the center line 903 is a square design with attached, end-loaded portions expanding (or flaring) from the corners of the square center to the perimeter portion 902. In this exemplary embodiment, the upper portion 920 comprises quad-fin cross-sectional shapes. However, the current invention is not limited thereto, and the upper portion 920 may also comprise, in part or in whole, end-loaded lateral cross-sectional shapes, e.g., similar in shape to the lateral cross-sectional shapes 902.

Furthermore, any dual-polarized, broadband, exponentially tapered or otherwise vertically lengthened array element could benefit from similar end-loading topological designs. Additionally, although not shown here, theoretically, narrower-band arrays, arrays with extreme scan angle requirements, and single-polarization arrays may also benefit from incorporating an end-loaded design.

While certain embodiments have been described above, it will be understood that the embodiments described are by way of example only. Accordingly, the descriptions herein should not be limited based on the described embodiments. Rather, the descriptions herein should only be limited in light of the claims that follow when taken in conjunction with the above description and accompanying drawings.

What is claimed is:

1. An antenna apparatus comprising:

a pair of spiked antenna elements elongated in a longitudinal direction from a bottom to a top and forming a radiating notch therebetween, each of the pair of spiked antenna elements comprising:

a base portion comprising a plurality of contiguous first lateral cross-sectional shapes, each of the plurality of first lateral cross-sectional shapes being end-loaded for increasing polarization stability; and an upper portion coupled to the base portion, the upper portion comprising a plurality of contiguous second lateral cross-sectional shapes, wherein the notch is narrower at the bottom than at the top.

2. The antenna apparatus of claim 1, wherein the antenna further comprises:

a balun portion coupled to the base portion; and an end-piece portion coupled to the upper portion.

3. The antenna apparatus of claim 2, wherein the plurality of contiguous first lateral cross-sectional shapes generally decrease in width from a first shape of the plurality of contiguous first lateral cross-sectional shapes to the last shape of the plurality of contiguous first lateral cross-sectional shapes, and wherein the plurality of contiguous second lateral cross-sectional shapes generally decrease in width from a first shape of the plurality of contiguous second lateral cross-sectional shapes to the last shape of the plurality of contiguous second lateral cross-sectional shapes.

4. The antenna apparatus of claim 1, wherein in each of the plurality of first lateral cross-sectional shapes, the end-loaded structure comprises four symmetric fins extending outward from a center line to an outer perimeter, and wherein the width of each of the fins at the outer perimeter is greater than the width of the corresponding fin at the center line.

5. The antenna apparatus of claim 1, wherein in each of the plurality of first lateral cross-sectional shapes, the end-loaded structure comprises four symmetric fins extending outward from a center line to an outer perimeter, and wherein the width of each of the fins at the outer perimeter is substantially greater than the width of the corresponding fin at the center line.

6. The antenna apparatus claim 1, wherein at least one of the plurality of contiguous second lateral cross-sectional shapes is end-loaded.

7. The antenna apparatus of claim 1, wherein the base portion is injected molded, and the upper portion is injected molded.

8. The antenna apparatus of claim 1, wherein the antenna apparatus is a dual-polarized, broadband, exponentially tapered, phased antenna array.

9. A method of controlling antenna polarization in a notched antenna array comprising:

providing a plurality of spiked antenna elements, each spiked antenna element of the notched antenna array extending generally in a longitudinal direction from a bottom to a top and having a base portion comprising a plurality of contiguous first lateral cross-sectional shapes, each of the plurality of first lateral cross-sectional shapes being end-loaded for increasing polarization stability, and an upper portion coupled to the base portion, the upper portion comprising a plurality of contiguous second lateral cross-sectional shapes;

disposing the spiked antenna elements in a spaced array to form a radiating notch in a space between adjacent ones of the spiked antenna elements, wherein the radiating notch is narrower at the bottom than at the top; and coupling the spiked antenna elements to a transmitter for driving the spiked antenna elements.

10. The method of claim 9, wherein each of the plurality of first lateral cross-sectional shapes comprises four symmetric fins extending outward from a center line to an outer perimeter, wherein a width of each of the fins at the outer perimeter is wider than a width of each of the fins at the center line.

11. An antenna array as in claim 9, wherein the base portion of the antenna element is injection molded.

12. An antenna array as in claim 11, wherein the upper portion of the antenna element is injection molded.

* * * * *